US007272960B2

(12) United States Patent
No et al.

(10) Patent No.: US 7,272,960 B2
(45) Date of Patent: Sep. 25, 2007

(54) WASHING MACHINE

(75) Inventors: Yang Hwan No, Changwon-si (KR); Jong Seok Kim, Changwon-si (KR); Han Ki Cho, Changwon-si (KR); Yeon Su Jung, Changwon-si (KR); Jung Hoon Kang, Changwon-si (KR); Young Hoon Ha, Masan-si (KR); Myung Sik Park, Changwon-si (KR)

(73) Assignee: LG Electronics Inc., Seoul (KR)

( * ) Notice: Subject to any disclaimer, the term of this patent is extended or adjusted under 35 U.S.C. 154(b) by 424 days.

(21) Appl. No.: 10/717,966

(22) Filed: Nov. 21, 2003

(65) Prior Publication Data

US 2004/0148971 A1 Aug. 5, 2004

(30) Foreign Application Priority Data

Nov. 28, 2002 (KR) ..... 10-2002-0075020

(51) Int. Cl.

| | |
|---|---|
| ***D06F 33/00*** | (2006.01) |
| ***D06F 39/04*** | (2006.01) |
| ***D06F 39/08*** | (2006.01) |
| ***D06F 29/00*** | (2006.01) |
| ***D06F 35/00*** | (2006.01) |
| ***D06F 37/00*** | (2006.01) |
| ***D06F 39/00*** | (2006.01) |

(52) U.S. Cl. ..... 68/12.05; 68/12.01; 68/12.21; 68/12.23; 68/207

(58) Field of Classification Search ..... 68/12.01, 68/12.21, 12.23, 20, 207
See application file for complete search history.

(56) References Cited

U.S. PATENT DOCUMENTS 4,835,991 A * 6/1989 Knoop et al. ..... 68/12.19
6,447,017 B1 * 9/2002 Gilbreath et al. ..... 285/89

* cited by examiner

*Primary Examiner*—Michael Kornakov
*Assistant Examiner*—Rita R Patel
(74) *Attorney, Agent, or Firm*—Ked & Associates, LLP

(57) ABSTRACT

A washing machine is provided which has a structurally reinforced apparatus for accurately sensing a water level. The washing machine includes a housing, a tub installed in the housing, a drum rotatably installed in the tub, and a water level sensing apparatus for sensing a water level in the tub/drum so as to provide an appropriate water level for each washing step. The water level sensing apparatus includes an air chamber installed in communication with the tub. The air chamber stores a predetermined amount such that the water present in the system develops a pressure on the stored air. The water level sensing apparatus also includes a sensor installed at an end of a tube connected to the air chamber which determines a water level by sensing an air pressure in the tube, and a protecting member which prevents disassembly and breakage of the air chamber and the tube during operation of the washing machine.

24 Claims, 3 Drawing Sheets

WASHING MACHINE

This application claims the benefit of Korean Application (s) No. 10-2002-0075020 filed on Nov. 28, 2002, which is/are hereby incorporated by reference.

BACKGROUND OF THE INVENTION

1. Field of the Invention

The present invention relates to a washing machine, and more particularly, to an apparatus for sensing a level of water in a washing machine.

2. Discussion of the Related Art

Generally, a washing machine includes a drum installed inside and rotates the drum to wash a laundry inside. The drum is supplied with appropriate amounts of water and detergent. And, the laundry is washed by a chemical reaction between the water and the detergent as well as a mechanical shock by a rotation of the drum. Moreover, the laundry is rinsed to eliminate the detergent and filth remaining after washing, and is then dewatered.

In order to perform a series of steps of washing, rinsing, and dewatering, the supply and discharge of the water should be appropriately controlled based on an accurate water level. Hence, the washing machine needs an apparatus for sensing the water level continuously. Such a sensing apparatus, which is sensitive and vulnerable in generally, may be easily broken by an external shock despite being installed in the washing machine. Specifically, a rotation of the drum brings sufficient vibrations to break the sensing apparatus, whereby it is highly probable that the washing machine malfunctions.

SUMMARY OF THE INVENTION

Accordingly, the present invention is directed to a washing machine that substantially obviates one or more of the problems due to limitations and disadvantages of the related art.

An object of the present invention, which has been devised to solve the foregoing problem, lies in providing a washing machine, by which an apparatus for sensing a level of water is provided to the washing machine.

An object of the present invention, which has been devised to solve the foregoing problem, lies in providing a washing machine provided with a structurally reinforced apparatus for sensing a level of water.

Additional features and advantages of the invention will be set forth in the description which follows, and in part will be apparent to those having ordinary skill in the art upon examination of the following or may be learned from a practice of the invention. The objectives and other advantages of the invention will be realized and attained by the subject matter particularly pointed out in the specification and claims hereof as well as in the appended drawings.

To achieve these objects and other advantages in accordance with the present invention, as embodied and broadly described herein, there is provided a washing machine including a housing, a tub installed in the housing to store water, a drum rotatably installed in the tub to hold a laundry, and a water level sensing apparatus for sensing a water level to provide an appropriate water level for each washing step. And, the water level sensing apparatus includes an air chamber storing a predetermined amount of air to communicate with the tub to have a pressure of the water work on the stored air, a sensor installed at the tube to sense the water level by sensing an air pressure in the tube, and a protecting member for preventing disassembly and breakage of the air chamber and the tube.

First of all, the air chamber is connected to a drainpipe connected to the tub for discharging the water. And, the air chamber is preferably connected to an extension pipe diverging from the drainpipe.

The tube is connected to an extension pipe extending from the air chamber to be connected to the air chamber.

The protecting member encloses a connecting portion between the air chamber and the tube and is substantially a rib extending from the air chamber to enclose a connecting portion between the air chamber and the tube. The rib is cylindrical and extends higher than the connecting portion.

Moreover, the protecting member securely fixes the air chamber to a peripheral part. The protecting member substantially includes a boss formed at the tub and a flange formed at the air chamber to be coupled to the boss.

Therefore, the washing machine according to the present invention includes the simply configured water level measuring equipment enabling to measure the water level accurately. And, the water level measuring equipment is structurally reinforced.

It is to be understood that both the foregoing explanation and the following detailed description of the present invention are exemplary and illustrative and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE PREFERRED EMBODIMENT(S)

Reference will now be made in detail to the preferred embodiment(s) of the present invention, examples of which are illustrated in the accompanying drawings. Throughout the drawings, like elements are indicated using the same or similar reference designations where possible.

Figure 1:
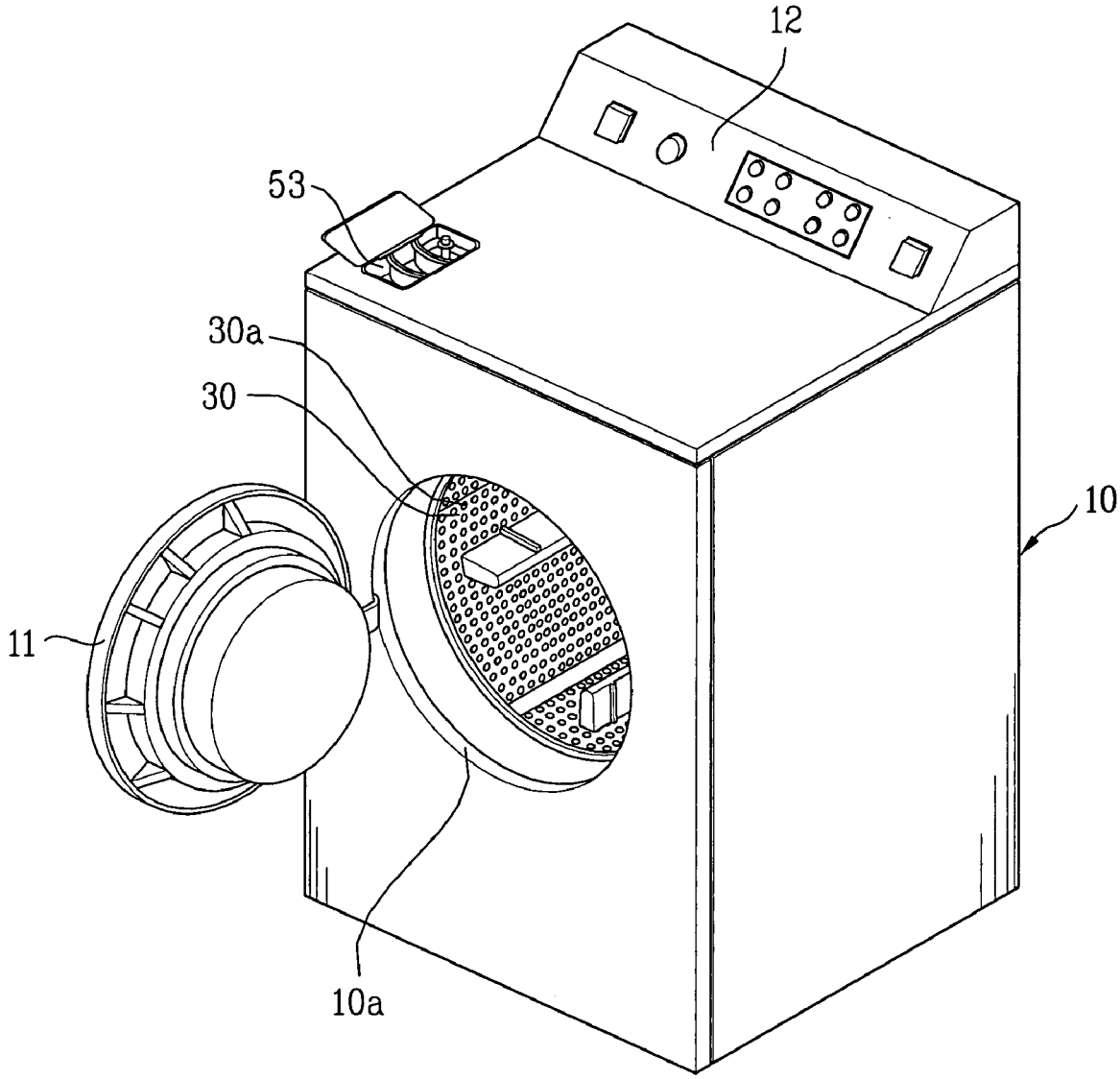
FIG. 1 is a perspective view of a washing machine according to the present invention.
Figure 2:
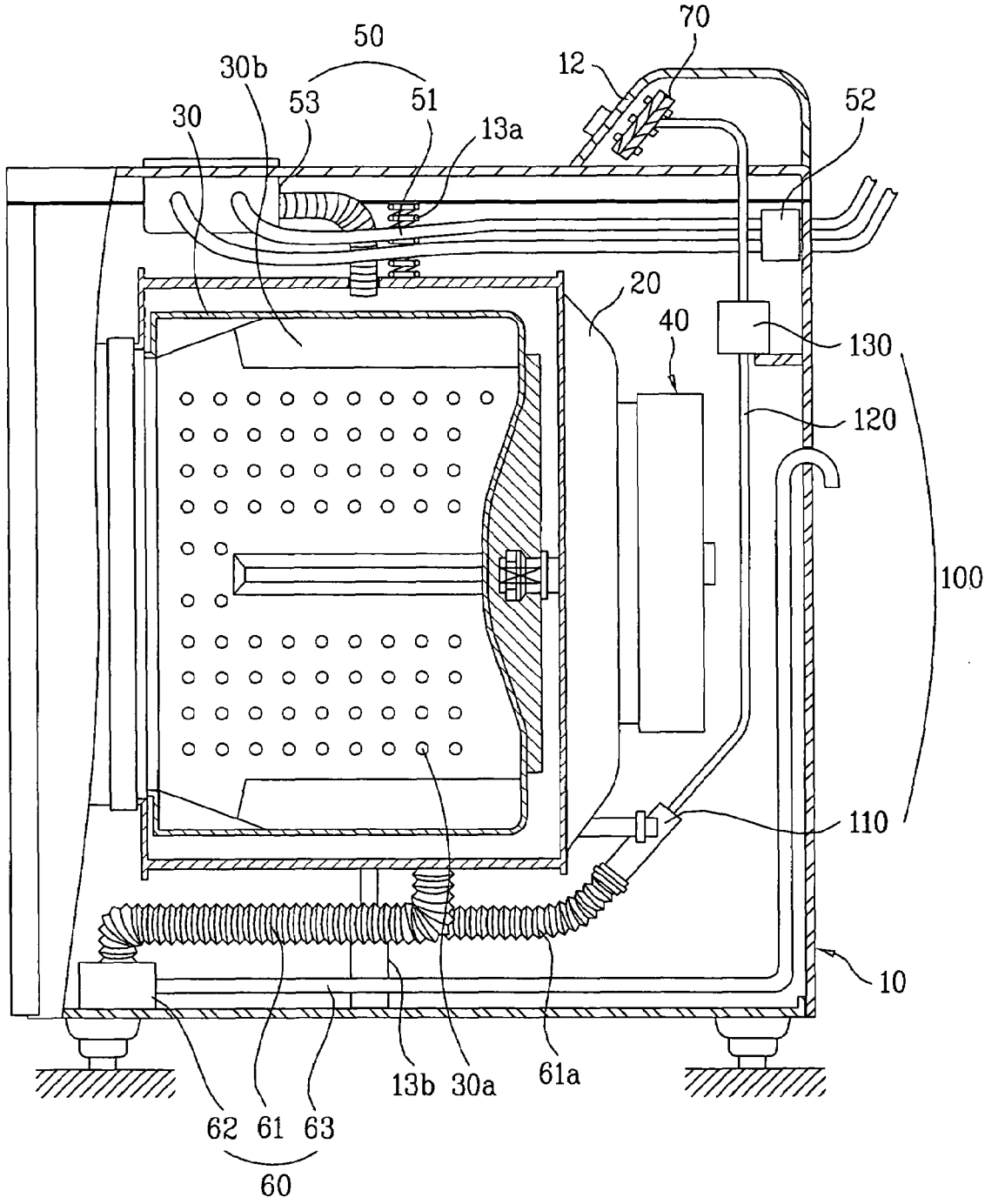
FIG. 2 is a cross-sectional view of a washing machine according to the present invention.

FIG. 1 is a perspective view of a washing machine according to the present invention and FIG. 2 is a cross-sectional view of a washing machine according to the present invention. The washing machine shown in FIG. 1 and FIG. 2 adopts a front loading type but is as good as a to loading type washing machine except that a tub 20 and a drum 30 are horizontally installed. For convenience of explanation, the present invention is described for the front loading type washing machine but is applicable to the top loading type washing machine the same manner.

Referring to FIG. 1 and FIG. 2, a washing machine according to the present invention basically includes a housing 10, a tub 20 installed in the housing 10, and a drum 30 in the tub 20.

The housing 10 is designed to hold various parts of the washing machine inside to protect. A door 11 is installed at a front side of the housing 10 to open/close an entrance 10*a* communicating with the drum 10, and a control panel 12 is installed on the housing 10. A user uses the control panel 12 to direct an operation of the washing machine and loads a laundry a laundry in/from the drum 30 via the door 11.

The tub 20 preliminary holds water to supply the water to the drum 30 uniformly. The tub 20 is elastically installed in the housing 10 using dampers 13*a* and 13*b*. A penetration hole (not shown) is formed at a bottom center of the tub 20, and a driving shaft (not shown) is installed through the penetration hole to be connected to the drum 30. Moreover, a plurality of ribs 20*c* are formed on a rear side of the tub 20 to enhance a rigidity of the tub 20.

The drum 30 holds a laundry and is rotatably installed in the tub 20. And, the drum 30 includes a multitude of perforated holes 30*a* to make the water flow in from the tub 20. Moreover, a plurality of baffles 30*b* are attached to an inner circumference of the drum 30 to mix the laundry well. A driving unit 40 is installed in the vicinity of the tub 20 to provide a dynamic force for a rotation of the drum 30. Specifically, the driving unit 40 includes a motor, a clutch, and the like and is connected to the drum 30 to drive through a driving shaft.

Moreover, in the washing machine, installed are a water supply equipment 50 for supplying the water to the tub 20 and a drain equipment 60 for discharging the used water. The water supply equipment 50 includes a water supply pipe 51, a valve 52 provided in the water supply pipe 51, and a detergent box 53. The water supply pipe 51 is connected to the tub 20 and extends through the housing 10 to be connected to an external water supply source. The valve 52 selectively opens or closes the water supply valve 51, and the detergent box 53 holds a predetermined amount of a detergent therein. Hence, once the valve 52 is turned on, the water follows the water supply pipe 51 from the water supply source to be supplied to the tub 20 together with the detergent via the detergent box 53. Moreover, the drain equipment 60 includes a first drainpipe 61, a pump 62, and a second drainpipe 63. Specifically, the first drainpipe 61 is connected to the tub 20 and the pump 62 and the second drainpipe 63 is connected to the pump 62 to extend outside the washing machine through the housing 10. Since the pump 62 substantially controls a discharge of the water, the supplied water is always held in the first drainpipe 61 before being discharged. After completion of a washing step, once the pump 62 operates, the used water is discharged outside via the first and second drainpipes 61 and 63. A control equipment 70 is installed inside the control panel 12 and is electrically connected to various equipments 40, 50, and 60. The control equipment 70 receives a user's direction as an electric signal through the control panel 12 and controls operations of the respective equipments 40, 50, and 60 according to such a direction.

In such a washing machine, in order to perform washing and rinsing steps optimally, water appropriate for a laundry amount should be supplied to the drum. Moreover, after the water has been completely discharged, washing, rinsing, and dewatering steps can be sequentially executed. In order to control the supply and discharge of the water, accurate information of the water level is needed. For this, a water level sensing apparatus 100 is provided in a washing machine according to the present invention.

The water level sensing apparatus 100, as shown in FIG. 2, includes an air chamber 110, a tube 120 connected to the air chamber 110, and a sensor 130 installed in the tube 120.

Figure 3:
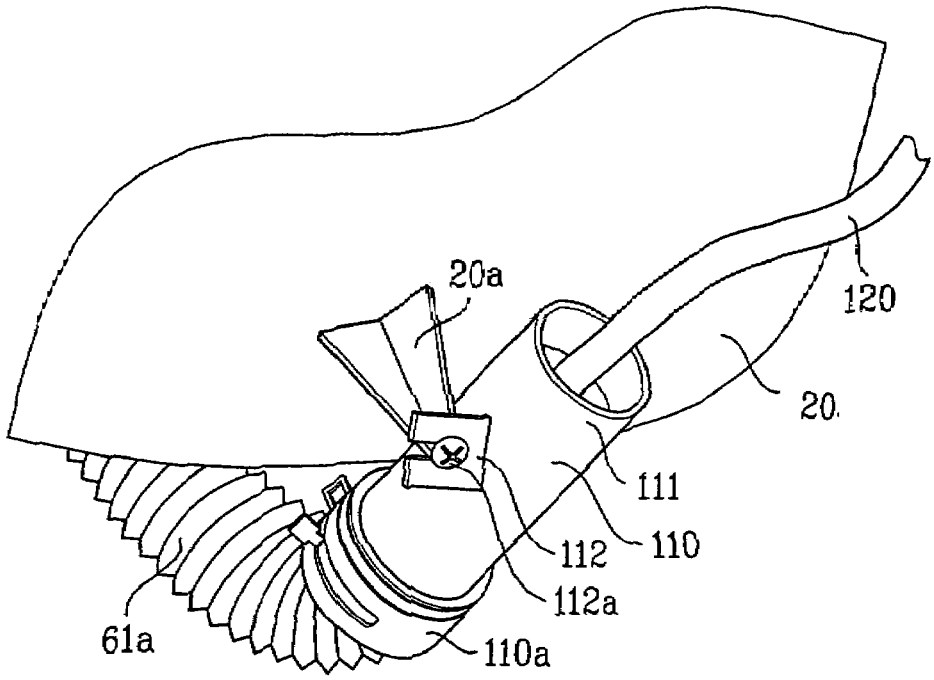
FIG. 3 is a perspective view of a water level sensing apparatus of a washing machine according to the present invention.

The air chamber 110 stores a predetermined amount of air and communicates with the tub 20. The air chamber 110, as shown in FIG. 2 and FIG. 3, includes a container forming a space for air storage inside. And, the air chamber 110 is connected to the first drainpipe 61 filled with the water instead of being directly connected to the tub 20 to communicate with. This is because the first drainpipe 61 is generally flexible to be conveniently connected to the air chamber 110. More preferably, the air chamber 110 is connected to an extension pipe 61*a* diverging from the first drainpipe 61 to freely adjust its installation location. The air chamber 110, as shown in FIG. 3, is securely coupled to the extension pipe 61*a* by a clamp 110*a*. Since the air chamber 110 communicates with the tub 20 directly or via the first drainpipe 61, a water pressure in the tub 20 works on the air in the air chamber 110. Hence, once the water level increases, the water pressure working on the stored air increases to raise the air pressure thereof.

The tube 120 is connected to the air chamber 110 so that the air pressure in the air chamber 110 is directly transferred to the air in the tube 120. Hence, if the air pressure in the air chamber 110 fluctuates according to the water level, the air pressure in the tube 120 fluctuates accordingly. Such a tube 120 is preferably connected to the extension pipe 110*b* at the air chamber 110 so as to be more securely connected to the air chamber 110.

The sensor 130 is a sort of a pressure sensor for sensing the air pressure in the tube 120. As the sensed air pressure is proportional to the water level, the water level of the water is substantially sensed by the sensing the air pressure. Moreover, the sensor 130 is electrically connected to the control equipment 70 and transfers a water level value continuously sensed during an operation of the washing machine to the control equipment 70. Hence, the control equipment 70 is provided with the sensed water level value to control the supply and discharge of the water. Namely, the control equipment 70 selectively drives the water supply or drain equipment 50 or 60 to provide various water levels appropriate for the washing, rinsing, and dewatering steps.

As mentioned in the foregoing description, the sensing apparatus 100 according to the present invention is designed to sense the water level of the water indirectly through the sensed air pressure. Hence, the sensing apparatus 100 has a simple structure but enables to accurately measure the water level of the water relatively.

Meanwhile, the water level sensing apparatus 100 inherently has a weak structure like other general sensing devices applied to other mechanical equipments. Specifically, in case of washing machine, the drum 30 rotates and vibrates to apply strong shocks to the water level sensing apparatus 100 possibly. Such shocks may disassemble or break the water level sensing apparatus 100. Hence, the water level sensing apparatus 100 according to the present invention further includes a protecting member for preventing such a disassembly or breakage.

Figure 4:
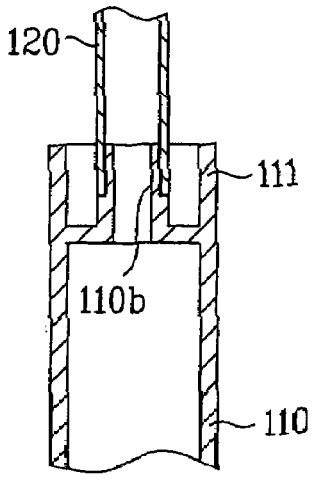
FIG. 4 is a cross-sectional view of a water level sensing apparatus of a washing machine according to the present invention.

Specifically, when the shocks are applied to the water level sensing apparatus 100, the air chamber 110 and the tube 120 are easily disassembled or their connecting portion may be easily broken. The tube 120, as shown in FIG. 4, may be separated from the extension pipe 110*b* by the shock. Further, the extension pipe 110*b* may be broken. Hence, the protecting member is configured to enclose the connecting portion between the air chamber 110 and the tube 120 for the protection against external shocks. Such a protecting member may be a rib 111 extending from the air chamber 110 to enclose the connecting portion. The rib 111 is formed cylindrical to entirely enclose the connecting portion between the air chamber 110 and the tube 120 and preferably extends higher over the connecting portion.

Moreover, the tub 20 repeatedly collides with the air chamber 110 by the vibrations of rotation. Such collisions bring about noises. If the collisions are repeated for a considerably long time, the air chamber 110 may be broken. Hence, the protecting member, a another embodiment, fixes the air chamber 110 securely so that the air chamber 110 fails to collide with neighboring parts, and more specifically, with the tub 20. To play a role of such a protecting member, a boss 20*a* and a flange 112, as shown in FIG. 3, are formed at the tub 20 and the air chamber 110, respectively. The boss 20*a* extends from the tub 20 to have a predetermined height, and the flange 112 is securely coupled to the boss 20*a* using a coupling member 112*a*. Hence, the air chamber 110 is fixed to the tub 20 to leave a predetermined interval, thereby failing to collide with the tub 20 which is vibrating so as not to be broken.

An operation of the washing machine according to the present invention is explained in detail by referring to the attached drawings as follows.

First of all, once a power of a washing machine is turned on, a water level and a washing time are set according to an amount of a laundry put in the drum 30. The control equipment 70 then turns on the valve 52 to supply water to the tub 20 via the water supply pipe 51.

The water passes the detergent box 53 to be mixed with the detergent and then flows in the tub 20 via the water supply pipe 51. And, the water starts to fill the first drainpipe 61 and the extension pipe 61*a* and then fills the tub 20 gradually.

In this case, the water in the first drainpipe 61 pressurizes the air in the air chamber 110 and the air in the tube 120 is compressed by the pressurized air of the air chamber 110. The sensor 130 measures the air pressure in the tube 120 to sense the water level and outputs the sensed water level to the control equipment 70. As the water level increases, so does the applied pressure. Hence, the air pressures in the air chamber 110 and the tube 120 gradually increase. The sensor 130 keeps sensing the increments of the pressure and water level to transfer to the control equipment 70.

The control equipment 70 turns off the valve 52 once the water reaches a setup water level based on the transferred water level information, and then rotates the drum 30 for a setup time using the driving unit 40. During rotation of the drum 30, filth or dirt is separated from the laundry by the reaction between the water and the detergent. Once the setup time expires, the control equipment 70 actuates the pump 62 so that the used water is discharged outside via the first and second drainpipes 61 and 63.

As the water level of the water is lowered during the draining, the pressure of the water and the air pressures in the air chamber 110 and the tube 120 decrease gradually. The sensor 130 senses a variation of the air pressure and a corresponding water level variation, and then keeps transferring variations of the sensed water level to the control equipment 70. The control equipment 70 judges that all the water in the tub 30 is discharged based on the transferred water level and then stops operating the pump 62.

After such a washing step, the washing machine executes a step of rinsing the washed laundry. Specifically, new water is supplied to the tub 30, the laundry is rinsed as many as a predetermined count by a rotation of the drum 30, and the used water is discharged outside the washing machine. In the supply and discharge of the water during such a rinsing step, the water level sensing apparatus, i.e., air chamber 110, tube 120, and sensor 130, keeps operating to sense the water level accurately as it did in the washing step. After the rinsing step, the drum 30 rotates at high speed to dewater the laundry.

Meanwhile, while the washing machine operates, the water level sensing apparatus, and more particularly, the air chamber 110 and the tube 120 are protected by the protecting members 111, 112, and 20*a*. Hence, an external shock fails to be applied to the water level sensing apparatus 100. Even if the external shock is applied thereto, the sensing apparatus 100 is not disassembled or broken.

Accordingly, the washing machine according to the present invention has the following advantages or effects.

First of all, the water level sensing apparatus of the washing machine according to the present invention includes the air chamber, tube, and sensor only to accurately sense the water level with the simple configuration. And, the protecting member prevents the water level sensing apparatus from being disassembled or broken by the external shock, whereby the malfunction of the washing machine due to failure of the water level sensing apparatus is prevented. Therefore, the accurate water level sensing and the prevention of the malfunction enhance the reliance of the washing machine according to the present invention.

It will be apparent to those skilled in the art that various modifications and variations can be made in the present invention without departing from the spirit or scope of the invention. Thus, it is intended that the present invention cover such modifications and variations, provided they come within the scope of the appended claims and their equivalents.

What is claimed is:

1. A washing machine, comprising:

a housing;

a tub installed in the housing and configured to hold washing fluid therein;

a drum rotatably installed in the tub and configured to hold laundry items therein; and a fluid level sensing apparatus configured to sense a washing fluid level and to provide an appropriate washing fluid level for each of a plurality of washing steps, the fluid level sensing apparatus comprising:

an air chamber configured to be connected to a drain extension pipe which extendes from the drainpipe installed in communication with the tub, wherein the air chamber is configured to store a predetermined amount of air such that a pressure of the washing fluid held in the tub imposes a corresponding pressure on the stored air;

a tube configured to be installed in communication with the air chamber;

a sensor coupled to the tube and configured to sense a washing fluid level by sensing an air pressure in the tube; and a protecting member configured to enclose a connecting portion formed between the air chamber and the tube.

2. The washing machine as claimed in claim 1, wherein the air chamber is configured to be connected to a drainpipe which extends from the tub for discharging washing fluid.

3. The washing machine as claimed in claim 1, wherein the tube is configured to be connected to an air extension pipe which extends from the air chamber.

4. The washing machine as claimed in claim 1, wherein the protecting member comprises a rib extending from the air chamber, wherein the rib is configured to enclose a connecting portion formed between the air chamber and the tube.

5. The washing machine as claimed in claim 4, wherein the rib is substantially cylindrical.

6. The washing machine as claimed in claim 4, wherein the rib extends beyond the connecting portion.

7. The washing machine as claimed in claim 1, wherein the protecting member is configured to attach the air chamber to a peripheral part of the washing machine.

8. The washing machine as claimed in claim 7, wherein the protecting member comprises a boss which extends from an outer surface of the tub and a flange which extends from an outer surface of the air chamber, wherein the flange is configured to be coupled to the boss so as to attach the air chamber to the outer surface of the tub.

9. The washing machine as claimed in claim 1, further comprising a control apparatus configured to control a supply and a discharge of washing fluid based on the sensed washing fluid level from the fluid level sensing apparatus.

10. An apparatus for sensing a fluid level of a washing machine, the apparatus comprising:

an air chamber configured to be connected to a drain extension pipe which extends from the drainpipe installed in communication with a tub which holds washing fluid, wherein the air chamber is configured to store a predetermined amount of air such that a pressure of the washing fluid held in the tub imposes a corresponding pressure on the stored air;

a tube configured to be installed in communication with the air chamber;

a sensor coupled to the tube and configured to sense a washing fluid level by sensing an air pressure in the tube; and a protecting member comprising a rib extending from the air chamber and configured to enclose a connecting portion formed between the air chamber and the tube so as to prevent breakage of the air chamber and the tube, or disassembly of the air chamber from the tube.

11. The apparatus as claimed in claim 10, wherein the air chamber is configured to be connected to a drainpipe which extends from the tub for discharging washing fluid.

12. The apparatus as claimed in claim 11, wherein the air chamber is configured to be connected to a drain extension pipe which extends from the drainpipe.

13. The apparatus as claimed in claim 10, wherein the tube is configured to be connected to an air extension pipe which extends from the air chamber.

14. The apparatus as claimed in claim 10, wherein the rib is substantially cylindrical.

15. The apparatus as claimed in claim 10 wherein the rib extends beyond the connecting portion.

16. The apparatus as claimed in claim 10, wherein the protecting member is configured to attach the air chamber to a peripheral part of the washing machine.

17. The apparatus as claimed in claim 16, wherein the protecting member comprises a boss which extends from an outer surface of a tub and a flange which extends from an outer surface of the air chamber, wherein the flange is configured to be coupled to the boss.

18. The apparatus as claimed in claim 17, wherein the protecting member further comprises a substantially cylindrical rib extending from an end of the air chamber which is configured to enclose a connecting portion formed between the air chamber and the tube.

19. The apparatus as claimed in claim 17, wherein the boss and the flange are configured to prevent contact between the air chamber and the tub when coupled.

20. The apparatus as claimed in claim 19, wherein the boss and the flange are configured to maintain a predetermined position of the air chamber relative to the tub when coupled.

21. The apparatus as claimed in claim 19, wherein the boss and the flange are configured to maintain a predetermined distance between the air chamber and the tub when coupled.

22. The washing machine as claimed in claim 3, wherein the air extension pipe extends from an end of the air chamber which is opposite an end of the air chamber connected to the tub by a drainpipe, wherein the air extension pipe and an end of the tube connected thereto form a connecting portion which is enclosed by a substantially cylindrical rib portion of the protecting member.

23. The washing machine as claimed in claim 8, wherein the protecting member further comprises a substantially cylindrical rib extending from an end of the air chamber which is configured to enclose a connecting portion formed between the air chamber and the tube.

24. A washing machine comprising the apparatus of claim 10.

* * * * *